US010513016B2

(12) United States Patent
Tabler et al.

(10) Patent No.: US 10,513,016 B2
(45) Date of Patent: Dec. 24, 2019

(54) TORQUE REACTION TOOLS AND METHODS FOR USE

(71) Applicant: The Boeing Company, Chicago, IL (US)

(72) Inventors: Bretton B. Tabler, Charleston, SC (US); Katie M. Plain, Charleston, SC (US); Gerald L. Haulbrooks, III, Charleston, SC (US)

(73) Assignee: The Boeing Company, Chicago, IL (US)

( * ) Notice: Subject to any disclaimer, the term of this patent is extended or adjusted under 35 U.S.C. 154(b) by 287 days.

(21) Appl. No.: 15/448,167

(22) Filed: Mar. 2, 2017

(65) Prior Publication Data

US 2018/0250798 A1 Sep. 6, 2018

(51) Int. Cl.
*B25B 23/00* (2006.01)

(52) U.S. Cl.
CPC ..... *B25B 23/0078* (2013.01); *B25B 23/0085* (2013.01)

(58) Field of Classification Search
CPC ..... B25B 23/0085; B25B 23/0078
USPC ..... 81/13
See application file for complete search history.

(56) References Cited

U.S. PATENT DOCUMENTS 847,768 A * 3/1907 Hartman ..... B25B 23/0085 81/13
2,102,897 A * 12/1937 Holhut ..... B25B 13/48 81/13
4,274,310 A 6/1981 Michaud
4,989,478 A * 2/1991 Trivedi ..... B25B 21/00 81/57.32
6,941,840 B1 9/2005 Harris
9,308,632 B2 4/2016 Junkers et al.
2001/0042294 A1* 11/2001 Long, Jr. ..... A01D 34/001 29/426.1
2003/0066392 A1 4/2003 Hsien
2017/0209992 A1* 7/2017 Stone ..... B25B 23/0085

OTHER PUBLICATIONS

Hytorc, "RFA Reaction Arm," <http://www.hytorc.nl/en/product/rfareactionarm/> printed Dec. 13, 2016, 6 pages.
Hytorc, "Avanti + RFA Reaction Arm on Flange Part," <http://www.hytorc.nl/en/project/avantirfareactionarmonflangepart/> printed Dec. 13, 2016, 3 pages.

* cited by examiner

*Primary Examiner* — Bryan R Muller
(74) *Attorney, Agent, or Firm* — McDonnell Boehnen Hulbert & Berghoff LLP

(57) ABSTRACT

An example torque reaction tool includes a first arm having an end with a longitudinally extending cavity, and an opposite end with a first socket drive element disposed perpendicular to a longitudinal axis of the cavity. The torque reaction tool further includes a second arm having an end portion slidably disposed within the cavity, and an opposite end with a second socket drive element thereon, oriented in the same direction as the first socket drive element. The torque reaction tool further includes a first fastener, disposed in a first threaded hole in the first arm that extends into the cavity, the first fastener being adjustable to engage the end portion of the second arm to restrict sliding movement of the second arm relative to the first arm.

9 Claims, 7 Drawing Sheets

TORQUE REACTION TOOLS AND METHODS FOR USE

FIELD

The present disclosure generally relates to torque reaction tools and methods for use, and more specifically to using a torque reaction tool to apply a holdback torque to a first fastener while a second fastener is tightened into a receptacle of the first fastener.

BACKGROUND

Mating fasteners are fasteners that are inserted and/or threaded into each other to apply a compressive force to various objects. One example of a pair of mating fasteners is a nut and a bolt. A technician tightens such a pair of mating fasteners by applying torque to the first fastener while applying a "holdback" torque to the second fastener. For example, the technician may use a breaker bar to apply a holdback torque to the second fastener while the technician uses another tool such as a socket wrench to tighten the first fastener into the second fastener.

Securing fasteners in this way may have drawbacks. In some situations, the technician might not be physically able to apply torque to both fasteners sufficient for tightening the fasteners, due to insufficient arm length or limited strength, for example. Also, obstructions may exist near one or both fasteners, which could force the technician into an awkward position in which the technician is on unstable footing or otherwise vulnerable to injury. Additionally, due to misalignment or other technician error, a breaker bar or another tool may slip off a fastener while the tool is being used to apply torque. This may damage nearby equipment or injure the technician or others nearby. Lastly, many tools might not be configured to remain secured against fasteners from an underneath position without the technician holding the tool to counteract gravity.

Accordingly, there is a need for a torque reaction tool that does not require the technician to assume awkward positions, reduces the probability of technician injury, and is securable to fasteners from an underneath position.

SUMMARY

In one example, a torque reaction tool includes a first arm having an end with a longitudinally extending cavity, and an opposite end with a first socket drive element disposed perpendicular to a longitudinal axis of the cavity. The torque reaction tool further includes a second arm having an end portion slidably disposed within the cavity, and an opposite end with a second socket drive element thereon, oriented in the same direction as the first socket drive element. The torque reaction tool further includes a first fastener, disposed in a first threaded hole in the first arm that extends into the cavity, the first fastener being adjustable to engage the end portion of the second arm to restrict sliding movement of the second arm relative to the first arm. The end portion of the second arm has a width that is not more than 90 percent of a width of the cavity, such that the end portion of the second arm is configured to rotationally bind within the cavity in response to torque applied about the first socket drive element or the second socket drive element, when coupled respectively to a first socket and a second socket positioned respectively over a second fastener and a third fastener.

In another example, a torque reaction tool includes a first orthogonally extending arm having an end with a longitudinally extending cavity, and an opposite end with a first socket drive element disposed perpendicular to a longitudinal axis of the cavity. The torque reaction tool further includes a second orthogonally extending arm having an end portion slidably disposed within the cavity, and an opposite end with a second socket drive element thereon, oriented in the same direction as the first socket drive element. The torque reaction tool further includes a first fastener, disposed in a first threaded hole in the first arm that extends into the cavity, the first fastener being adjustable to engage the end portion of the second arm to restrict sliding movement of the second arm relative to the first arm. The end portion of the second arm has a width that is not more than 90 percent of a width of the cavity, such that the end portion of the second arm is configured to rotationally bind within the cavity in response to torque applied about the first socket drive element or the second socket drive element when coupled to a respective first socket and second socket positioned respectively over a second fastener and a third fastener.

Another example includes a method for using a torque reaction tool, the torque reaction tool having a first arm and a second arm slidably disposed within a cavity of the first arm. The method includes sliding the second arm within the cavity to adjust a distance between a first socket drive element on the first arm and a second socket drive element on the second arm. The method further includes mating a first socket with a first fastener and a second socket with a second fastener, where the first socket is mated with the first socket drive element and the second socket is mated with the second socket drive element. The method further includes tightening a third fastener of the torque reaction tool such that the third fastener penetrates into the cavity and restricts movement of the second arm within the cavity. The method further includes adjusting a fourth fastener mated with the first fastener or a fifth fastener mated with the second fastener to cause the second arm to tilt with respect to a longitudinal axis of the cavity, thereby binding the second arm within the cavity and securing the torque reaction tool to the first fastener and the second fastener. The method further includes releasing the torque reaction tool from the first fastener and the second fastener by loosening the third fastener to allow the second arm to slide within the cavity.

The features, functions, and advantages that have been discussed can be achieved independently in various embodiments or may be combined in yet other embodiments further details of which can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and descriptions thereof, will best be understood by reference to the following detailed description of an illustrative embodiment of the present disclosure when read in conjunction with the accompanying Figures.

DETAILED DESCRIPTION

Figure 1:
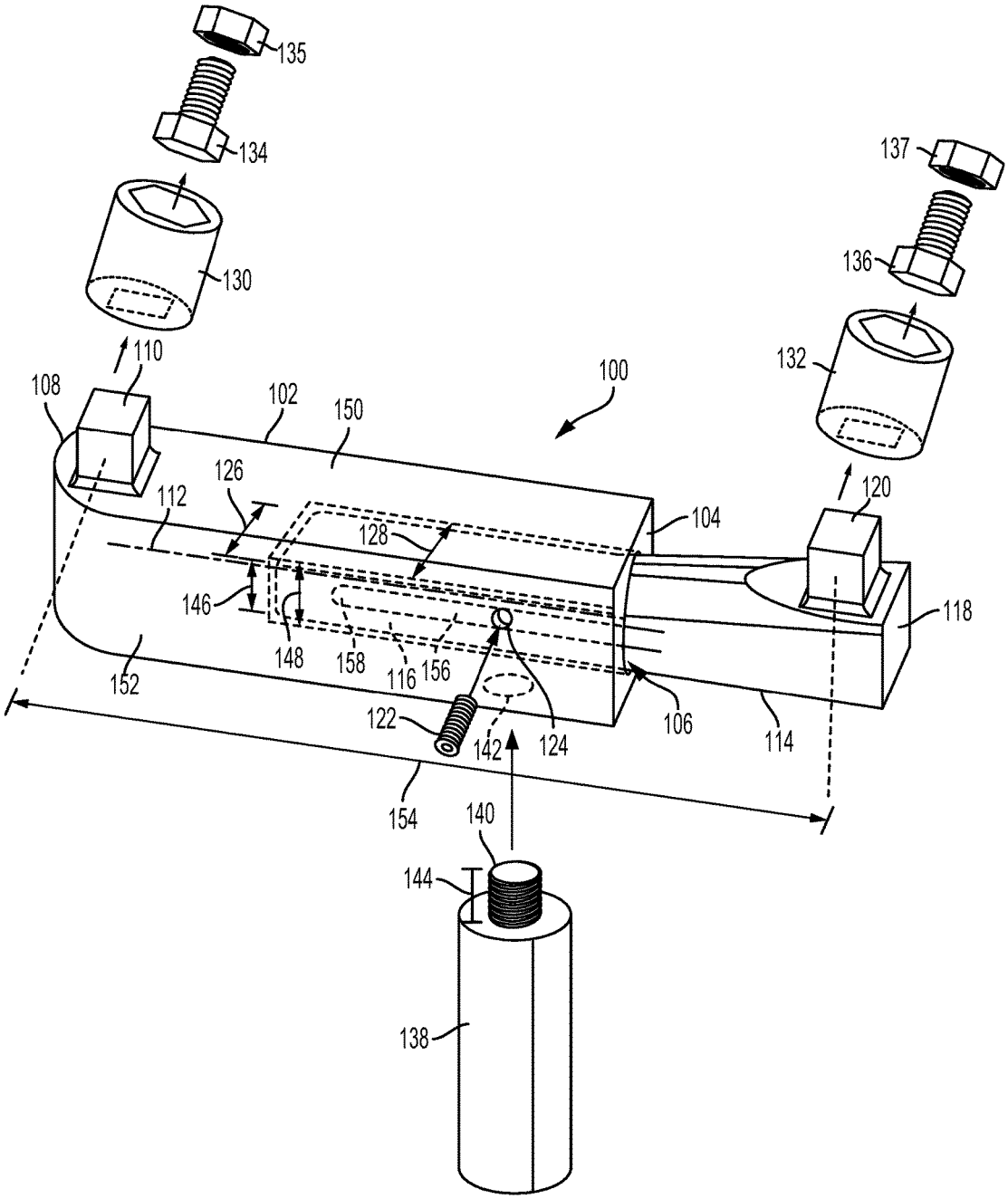
FIG. 1 illustrates a torque reaction tool, according to an example embodiment.

As discussed above, there are conventional methods and tools for applying a holdback torque to a second fastener as a first fastener is tightened into a receptacle of the second fastener. Alternative tools and methods are described herein.

An example torque reaction tool includes a first arm, a second arm, and a fastener. The first arm has an end with a longitudinally extending cavity, and an opposite end with a first socket drive element disposed perpendicular to a longitudinal axis of the cavity. The second arm has an end portion slidably disposed within the cavity, and an opposite end with a second socket drive element thereon. The second socket drive element is oriented in the same direction as the first socket drive element. The fastener is disposed in a first threaded hole in the first arm that extends into the cavity. The fastener is adjustable to engage the end portion of the second arm to restrict sliding movement of the second arm relative to the first arm. The end portion of the second arm has a width that is not more than 90 percent of a width of the cavity, such that the end portion of the second arm is configured to rotationally bind within the cavity in response to torque applied about the first socket drive element or the second socket drive element, when the socket drive elements are coupled respectively to a pair of sockets positioned respectively over a first pair of fasteners.

In a more detailed example, the tool also includes a handle having a threaded end disposed in a second threaded hole in the first arm that extends into the cavity. The threaded end of the handle has a length sufficient to extend into the cavity and engage the end portion of the second arm to restrict movement of the second arm. In another example, the socket drive elements may be offset from the longitudinal axis of the cavity such that the tool is useful for tightening fasteners in hard to reach places.

In an example use of the tool, a technician slides the second arm within the cavity to adjust a distance between the socket drive elements to match the spacing of the first pair of fasteners to be adjusted. The technician then mates the pair of sockets with the first pair of fasteners and mates the sockets with the socket drive elements of the tool. The technician then tightens the fastener of the torque reaction tool such that the fastener penetrates into the cavity and restricts movement of the second arm within the cavity. The technician then adjusts one or more of a second pair of fasteners that are mated with the first pair of fasteners to cause the second arm to tilt, rotate, or otherwise move with respect to the longitudinal axis of the cavity. This binds the second arm within the cavity and secures the torque reaction tool to the first pair of fasteners to be adjusted. After tightening the first pair of fasteners into or onto the second pair of fasteners, the technician releases the torque reaction tool from the first pair of fasteners by loosening the fastener of the tool to allow the second arm to slide within the cavity.

The torque reaction tool may render some of the torque that would otherwise be applied by the technician unnecessary, perhaps enabling the technician to avoid awkward positions and to prevent injury to the technician or others. The tool may also be securable to fasteners from an underneath position and/or confined spaces, simplifying various adjustment tasks. The generic socket drive elements of the tool also enable the use of different socket sizes for fasteners that differ in size.

Disclosed embodiments will now be described more fully hereinafter with reference to the accompanying Drawings, in which some, but not all of the disclosed embodiments are shown. Indeed, several different embodiments may be described and should not be construed as limited to the embodiments set forth herein. Rather, these embodiments are described so that this disclosure will be thorough and complete and will fully convey the scope of the disclosure to those skilled in the art.

By the term "about" or "substantially" with reference to amounts or measurement values described herein, it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

FIG. 1 depicts an example torque reaction tool 100. A technician may adjust the torque reaction tool 100 such that a distance 154 between socket drive elements 110 and 120 matches the distance between the fasteners 134 and 136. The fasteners 134 and 136 may be bolts that are mated respectively with fasteners 135 and 137. In FIG. 1, the fasteners 135 and 137 take the form of nuts. In other examples, the torque reaction tool 100 may be mated to nuts via sockets 130 and 132 to provide a holdback torque for tightening one or more bolts. The fasteners 134-137 may be used to compress two or more objects (not shown) together, but other examples are possible. For example, the fasteners 134-137 might be used to secure a pair of flanged fittings (not shown) to each other. The torque reaction tool 100 may be used to apply a holdback torque to the fastener 134 as the fastener 135 is tightened onto the fastener 134, or vice versa.

The torque reaction tool 100 includes an arm 102, an arm 114, and a fastener 122. The arm 102 includes an end 104, a cavity 106, an end 108, the socket drive element 110, a threaded hole 124, a threaded hole 142, a surface 150, and a surface 152. The arm 114 includes an end portion 116, an end 118, a socket drive element 120, and a groove 156 having an end 158.

The arm 102 is constructed of metal, carbon fiber, or some other material(s) capable of withstanding various forces or torques described herein. The end 104 of the arm 102 is open to the cavity 106. As depicted in FIG. 1, the cavity 106 extends from the end 104 about two thirds of the way to the end 108, but other examples are possible. A cross-section of the cavity 106 may have an oval shape, a cylindrical shape, a non-cylindrical shape, or a rectangular shape as well as other shapes. In some examples, the cavity 106 might have a shape similar to, but slightly larger than, the end portion 116 of the arm 114 to accommodate sliding movement of the end portion 116 within the cavity 106. In other examples, the cavity 106 might differ in shape from the end portion 116. For instance, the end portion 116 might have a square cross-sectional shape and the cavity 106 might have a hexagonal cross-sectional shape. In another example, the end portion 116 might have a hexagonal cross-sectional shape and the cavity 106 might have a square cross-sectional shape.

For example, the end portion 116 of the arm 114 may have a width 126 that is not more than 90 percent of the width 128 of the cavity 106. Similarly, the end portion 116 of the arm 114 may have a height 146 that is not more than 90 percent of the height 148 of the cavity 106. As depicted in FIG. 1, the width 126 and height 146 may refer to a constant width and a constant height of the end portion 116 within the cavity 106. In other examples, the end portion 116 might not have a constant height or a constant width. Accordingly, as used herein, the term "cross-sectional width" may refer to a maximum width of the end portion 116 within the cavity 106 along the direction of the width 126, and the term "cross-sectional height" may refer to a maximum height of the end portion 116 within the cavity 106 along the direction of the height 146. In one illustrative embodiment, the cavity 106 may have a cross-sectional width of 0.85 inches and a cross-sectional height of 0.85 inches, for example, and the end portion 116 of the arm 114 may have a cross-sectional width of 0.75 inches and a cross-sectional height of 0.75 inches, for example. In other examples, the end portion 116 may have different dimensions for a maximum width and height of the end portion that is not more than 90 percent of the height and width of the cavity 106, and might not have a constant height or a constant width.

Generally, the shape and dimensions of the cavity 106 and the shape and dimensions of the end portion 116 prevent the end portion 116 from rotating a large amount about the longitudinal axis 112. Similarly, the shape and dimensions of the cavity 106 and the shape and dimensions of the end portion 116 generally prevent significant tilting of the end portion 116 with respect to the longitudinal axis 112. However, when the socket drive elements 110 and 120 are fitted with sockets 130 and 132 that are mated with the fasteners 134 and 136, the end portion 116 may, in response to a torque applied to either of the fasteners 135 or 137, tilt or rotate a small amount (e.g., 1 to 5 degrees) within the cavity 106 to "lock" the torque reaction tool 100 onto the fasteners 134 and 136 and to lock the arm 114 in position with respect to the arm 102. In this "locked" condition, a technician may apply a tightening torque to either of the fasteners 135 or 137, and the torque reaction tool 100 will generally provide a holdback torque at one or more of the fasteners 134 or 136.

The socket drive element 110 is at or near the end 108 of the arm 102 and is disposed perpendicular to or substantially perpendicular to the longitudinal axis 112. For example, the socket drive element 110 may be disposed at an angle ranging from 85 to 95 degrees with respect to the longitudinal axis 112. The socket drive element 110 may be configured to be mated with the socket 130. As depicted in FIG. 1, the socket drive element 110 is a square protrusion, but the socket drive element 110 may have any shape that matches a receiving hole of a socket. The socket 130 is configured to apply a rotational force to a fastener, such as the fastener 134.

The arm 114 is also constructed of metal, carbon fiber, or some other material(s) capable of withstanding various forces or torques described herein. In FIG. 1, the end portion 116 of the arm 114 is slidably disposed within the cavity 106. The socket drive element 120 is positioned at or near the end 118 of the arm 114.

The socket drive element 120 is disposed perpendicular to or substantially perpendicular to the longitudinal axis 112, that is, in the same general direction as the socket drive element 110. For example, the socket drive element 120 may be disposed at an angle ranging from 85 to 95 degrees with respect to the longitudinal axis 112. The socket drive element 120 may be configured to be mated with the socket 132. As depicted in FIG. 1, the socket drive element 120 is a square protrusion, but the socket drive element 120 may have any shape that matches a receiving hole of a socket. The socket 132 is configured to apply a rotational force to a fastener, such as the fastener 136.

The arm 114 includes a groove 156 that is adjacent to the surface 152 of the arm 102. The groove 156 is configured to receive the fastener 122 when the fastener 122 is inserted into the threaded hole 124 of the arm 102.

The fastener 122 may take the form of a set screw, but other examples are possible. When secured tightly against the groove 156, the fastener 122 may facilitate restricting the movement of the end portion 116 of the arm 114 within the cavity 106. When loosened but still within the groove 156, the fastener 122 may allow the arm 114 to slide out of the cavity 106 until the fastener abuts the end 158 of the groove 156. Further loosening of the fastener 122 may remove the fastener 122 from the groove 156, allowing the arm 114 to be completely removed from the cavity 106. The arm 114 may have an additional groove similar to the groove 156 on a surface of the arm 114 that is opposite the surface on which the groove 156 is disposed. Such an additional groove may be configured to receive an additional fastener through the threaded hole 125 (shown in FIG. 2).

The torque reaction tool 100 may also include a handle 138. The handle 138 may include a threaded end 140 disposable in the threaded hole 142 that extends into the cavity 106. The threaded end 140 may have a length 144 sufficient to extend into the cavity 106 and engage the end portion 116 of the second arm 114 to restrict movement of the second arm 114. The length 144 may be within a range of 0.25 to 0.5 inches, for example. The handle 138 may also provide a portion of the torque reaction tool 100 for a technician to grasp.

Figure 2:
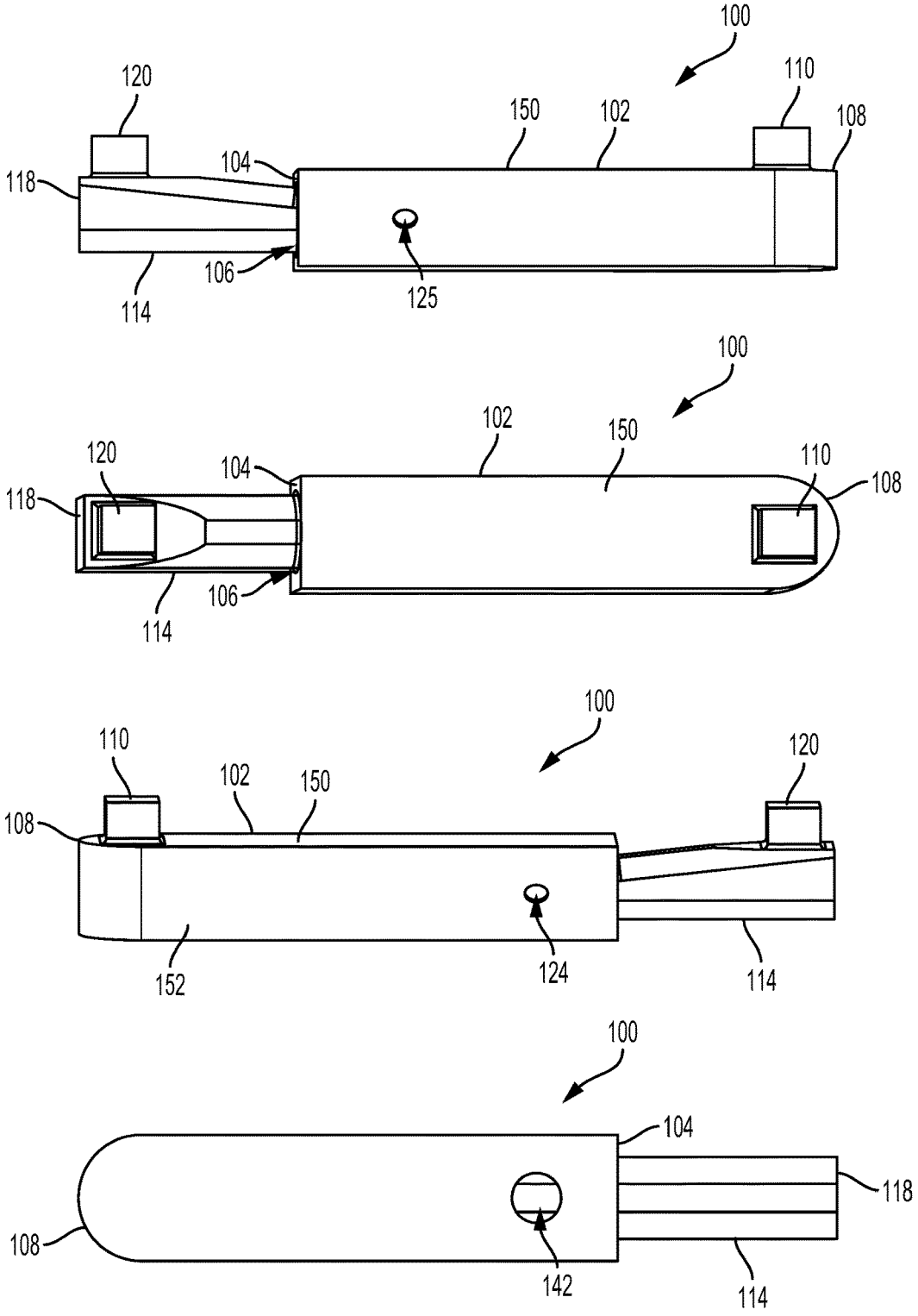
FIG. 2 illustrates a torque reaction tool, according to an example embodiment.

FIG. 2 depicts additional views of the torque reaction tool 100. The topmost view of FIG. 2 shows the threaded hole 125 that is disposed opposite the threaded hole 124. A fastener similar to the fastener 122 can be inserted in to the threaded hole 125 to function similarly to the fastener 122. The second view from the top is an overhead view of the torque reaction tool 100. The third view from the top has a perspective similar to FIG. 1. The bottommost view of FIG. 2 shows an underneath view of the torque reaction tool 100.

Figure 3:
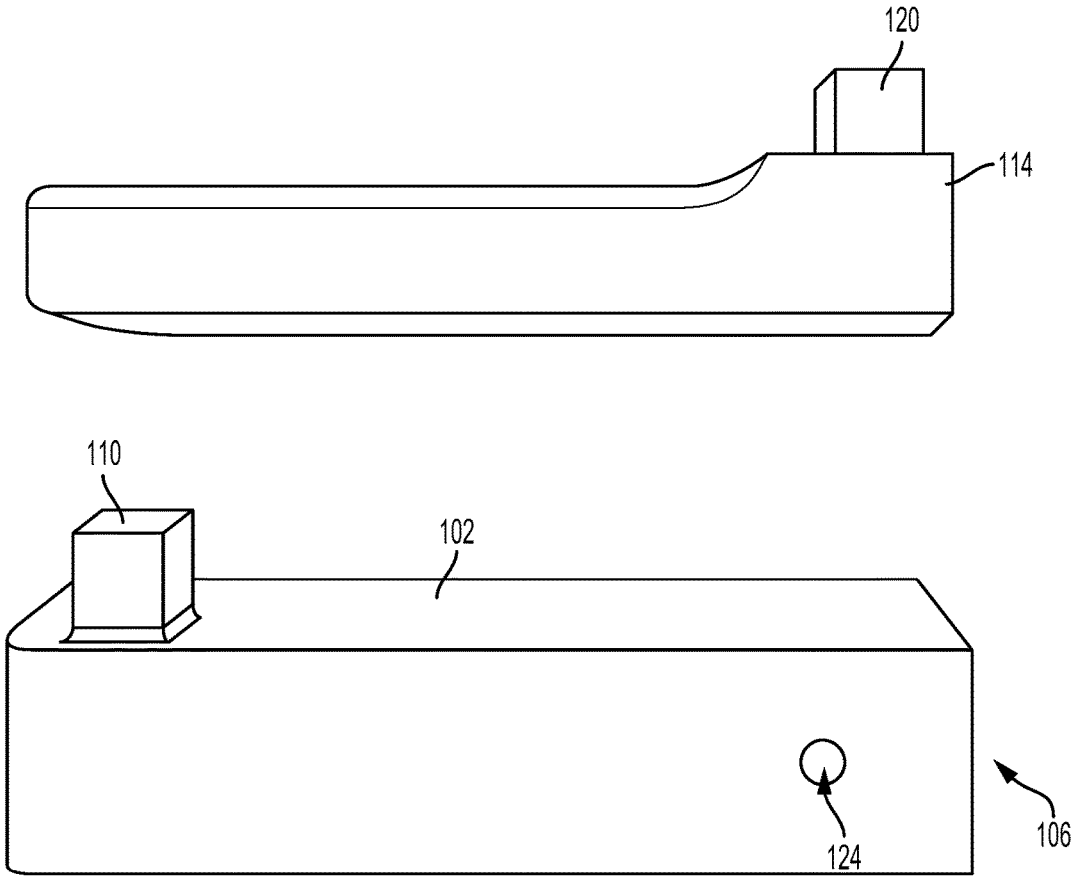
FIG. 3 illustrates a torque reaction tool, according to an example embodiment.

FIG. 3 shows the arm 102 and the arm 114 in a disassembled state, that is, a state where the arm 114 has been removed from the cavity 106.

Figure 4:
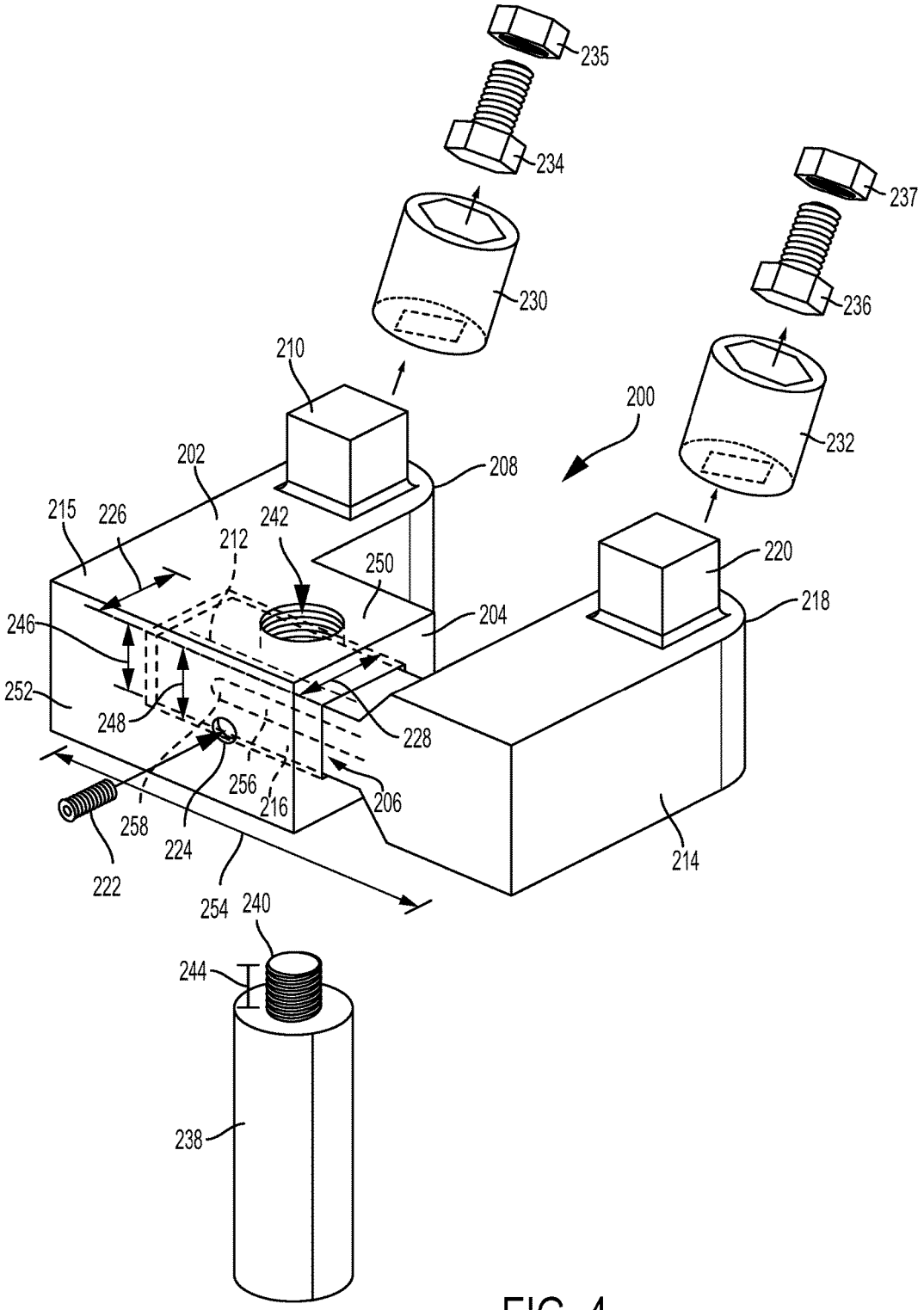
FIG. 4 illustrates a torque reaction tool, according to an example embodiment.

FIG. 4 depicts an example torque reaction tool 200 which is similar to the torque reaction tool 100 in several aspects. However, one way that the torque reaction tool 200 differs from the torque reaction tool 100 is that the torque reaction tool 200 has a c-shaped design which may allow a technician to apply the torque reaction tool 200 to fasteners that are behind obstructions or are otherwise hard to reach.

A technician may adjust the torque reaction tool 200 such that a distance 254 between socket drive elements 210 and 220 matches the distance between the fasteners 234 and 236. The fasteners 234 and 236 may be bolts that are mated respectively with fasteners 235 and 237. In FIG. 4, the fasteners 235 and 237 take the form of nuts. In other examples, the torque reaction tool 200 may be mated to nuts via sockets 230 and 232 to provide a holdback torque for tightening one or more bolts. The fasteners 234-237 may be used to compress two or more objects (not shown) together, but other examples are possible. For example, the fasteners 234-237 might be used to secure a pair of flanged fittings (not shown) to each other. The torque reaction tool 200 may be used to apply a holdback torque to the fastener 234 as the fastener 235 is tightened onto the fastener 234, or vice versa.

The torque reaction tool 200 includes an arm 202, an arm 214, and a fastener 222. The arm 202 includes an end 204, a cavity 206, an end 208, the socket drive element 210, a threaded hole 224, a threaded hole 242, a surface 250, and a surface 252. The arm 214 includes an end portion 216, an end 218, a socket drive element 220, and a groove 256 having an end 258.

The arm 202 is constructed of metal, carbon fiber, or some other material(s) capable of withstanding various forces or torques described herein. In contrast to the arm 102 of the torque reaction tool 100, the arm 202 has an l-shape that forms a right angle. The end 204 of the arm 202 is open to the cavity 206. As depicted in FIG. 4, the cavity 206 extends from the end 204 about two thirds of the way to the l-shaped corner 215 of the arm 202, but other examples are possible. A cross-section of the cavity 206 may have an oval shape, a cylindrical shape, a non-cylindrical shape, or a rectangular shape as well as other shapes. In some examples, the cavity 206 might have a shape similar to, but slightly larger than, the end portion 216 of the arm 214 to accommodate sliding movement of the end portion 216 within the cavity 206. In other examples, the cavity 206 might differ in shape from the end portion 216. For instance, the end portion 216 might have a square cross-sectional shape and the cavity 206 might have a hexagonal cross-sectional shape. In another example, the end portion 216 might have a hexagonal cross-sectional shape and the cavity 206 might have a square cross-sectional shape.

For example, the end portion 216 of the arm 214 may have a width 226 that is not more than 90 percent of the width 228 of the cavity 206. Similarly, the end portion 216 of the arm 214 may have a height 246 that is not more than 90 percent of the height 248 of the cavity 206. As depicted in FIG. 4, the width 226 and height 246 may refer to a constant width and a constant height of the end portion 216 within the cavity 206. In other examples, the end portion 216 might not have a constant height or a constant width. Accordingly, as used herein, the term "cross-sectional width" may refer to a maximum width of the end portion 216 within the cavity 206 along the direction of the width 226, and the term "cross-sectional height" may refer to a maximum height of the end portion 216 within the cavity 206 along the direction of the height 246. In one illustrative embodiment, the cavity 206 may have a cross-sectional width of 0.75 inches and a cross-sectional height of 0.55 inches, for example, and the end portion 216 of the arm 214 may have a cross-sectional width of 0.65 inches and a cross-sectional height of 0.45 inches, for example. In other examples, the end portion 216 may have different dimensions for a maximum width and height of the end portion that is not more than 90 percent of the height and width of the cavity 206, and might not have a constant height or a constant width.

Generally, the shape and dimensions of the cavity 206 and the shape and dimensions of the end portion 216 prevent the end portion 216 from rotating a large amount about the longitudinal axis 212. Similarly, the shape and dimensions of the cavity 206 and the shape and dimensions of the end portion 216 generally prevent significant tilting of the end portion 216 with respect to the longitudinal axis 212. However, when the socket drive elements 210 and 220 are fitted with sockets 230 and 232 that are mated with the fasteners 234 and 236, the end portion 216 may, in response to a torque applied to either of the fasteners 235 or 237, tilt or rotate a small amount (e.g., 1 to 5 degrees) within the cavity 206 to "lock" the torque reaction tool 200 onto the fasteners 234 and 236 and to lock the arm 214 in position with respect to the arm 202. In this "locked" condition, a technician may apply a tightening torque to either of the fasteners 235 or 237, and the torque reaction tool 200 will generally provide a holdback torque at one or more of the fasteners 234 or 236.

The socket drive element 210 is at or near the end 208 of the arm 202 and, although offset from the longitudinal axis 212, may be disposed perpendicular to or substantially perpendicular to the longitudinal axis 212. For example, the socket drive element 210 may be disposed at an angle ranging from 85 to 95 degrees with respect to the longitudinal axis 212 if the socket drive element 210 were translated to be coplanar with the longitudinal axis 212. The socket drive element 210 may be configured to be mated with the socket 230. As depicted in FIG. 4, the socket drive element 210 is a square protrusion, but the socket drive element 210 may have any shape that matches a receiving hole of a socket. The socket 230 is configured to apply a rotational force to a fastener, such as the fastener 234.

The arm 214 is also constructed of metal, carbon fiber, or some other material(s) capable of withstanding various forces or torques described herein. In contrast to the arm 114 of the torque reaction tool 100, the arm 202 has an l-shape that forms a right angle. In FIG. 4, the end portion 216 of the arm 214 is slidably disposed within the cavity 206. The socket drive element 220 is positioned at or near the end 218 of the arm 214.

Although offset from the longitudinal axis 212, the socket drive element 220 is disposed perpendicular to or substantially perpendicular to the longitudinal axis 212, that is, in the same general direction as the socket drive element 210. For example, the socket drive element 220 may be disposed at an angle ranging from 85 to 95 degrees with respect to the longitudinal axis 212 if the socket drive element 220 were translated to be coplanar with the longitudinal axis 212. The socket drive element 220 may be configured to be mated with the socket 232. As depicted in FIG. 4, the socket drive element 220 is a square protrusion, but the socket drive element 220 may have any shape that matches a receiving hole of a socket. The socket 232 is configured to apply a rotational force to a fastener, such as the fastener 236.

The arm 214 includes a groove 256 that is adjacent to the surface 252 of the arm 202. The groove 256 is configured to receive the fastener 222 when the fastener 222 is inserted into the threaded hole 224 of the arm 202.

The fastener 222 may take the form of a set screw, but other examples are possible. When secured tightly against the groove 256, the fastener 222 may facilitate restricting the movement of the end portion 216 of the arm 214 within the cavity 206. When loosened but still within the groove 256, the fastener 222 may allow the arm 214 to slide out of the cavity 206 until the fastener abuts the end 258 of the groove 256. Further loosening of the fastener 222 may remove the fastener 222 from the groove 256, allowing the arm 214 to be completely removed from the cavity 206.

The torque reaction tool 200 may also include a handle 238. The handle 238 may include a threaded end 240 disposable in the threaded hole 242 that extends into the cavity 206. The threaded end 240 may have a length 244 sufficient to extend into the cavity 206 and engage the end portion 216 of the second arm 214 to restrict movement of the second arm 214. The length 244 may be within a range of 0.25 to 0.5 inches, for example. The handle 238 may also provide a portion of the torque reaction tool 200 for a technician to grasp.

Figure 5:
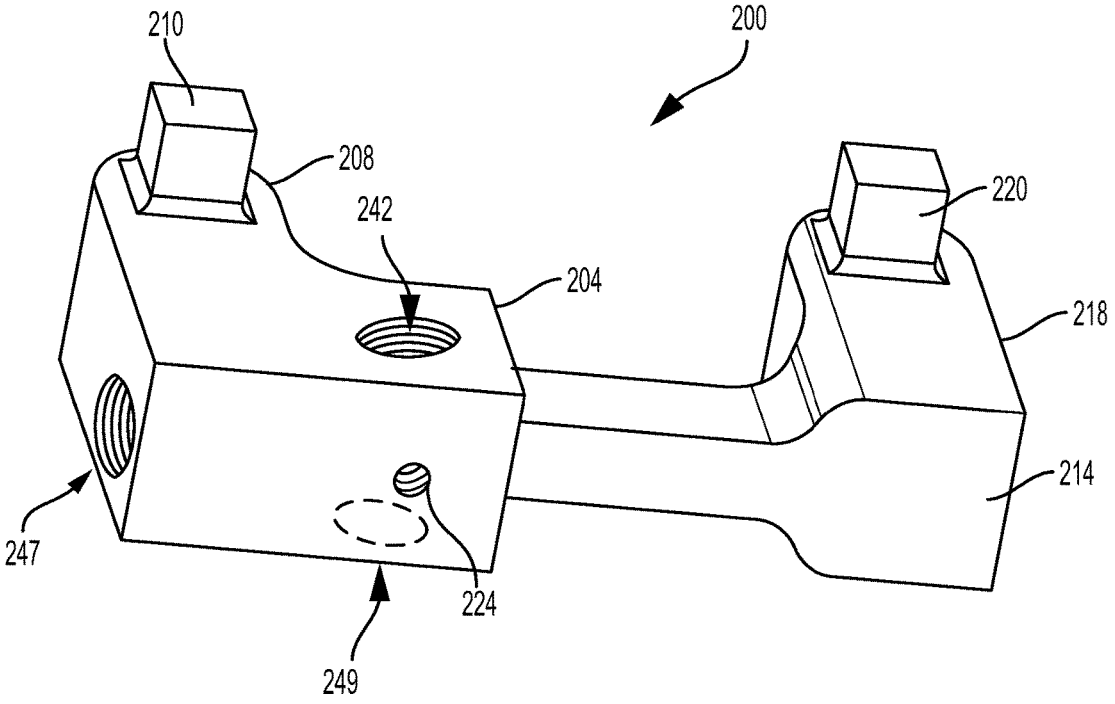
FIG. 5 illustrates a torque reaction tool, according to an example embodiment.

FIG. 5 provides an additional view of the torque reaction tool 200. FIG. 5 shows additional threaded holes 247 and 249 through which the threaded end 240 of the handle 238 may be inserted. The threaded end 240 may be tightened into the hole 242 to restrict movement of the second arm 214 within the cavity 206 and so that the handle 238 serves as a handle for a technician. The threaded end 240 may alternatively be inserted into the threaded hole 247, but the handle 238 will generally function only as a handle in that position.

Figure 6:
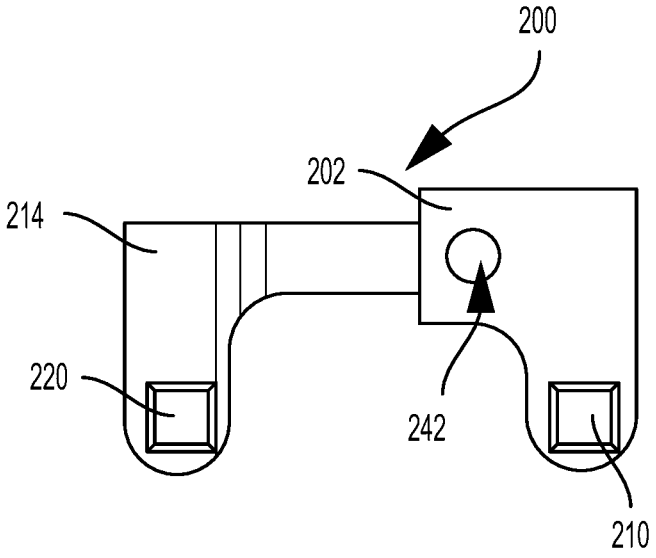
FIG. 6 illustrates a torque reaction tool, according to an example embodiment.
Figure 6:
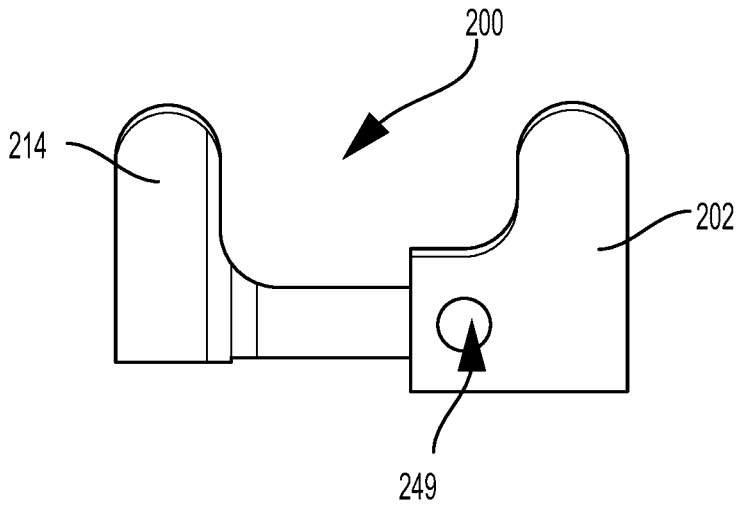

FIG. 6 provides additional views of the torque reaction tool 200. The top view is a downward looking view of the torque reaction tool 200, whereas the bottom view is an upward looking view of the torque reaction tool 200. It should be noted that FIGS. 5 and 6 show the torque reaction tool 200 (specifically the arms 202 and 214) having slightly different shapes with respect to the torque reaction tool 200 depicted in FIG. 4. These differences generally will not affect the functionality of the torque reaction tool 200.

Figure 7:
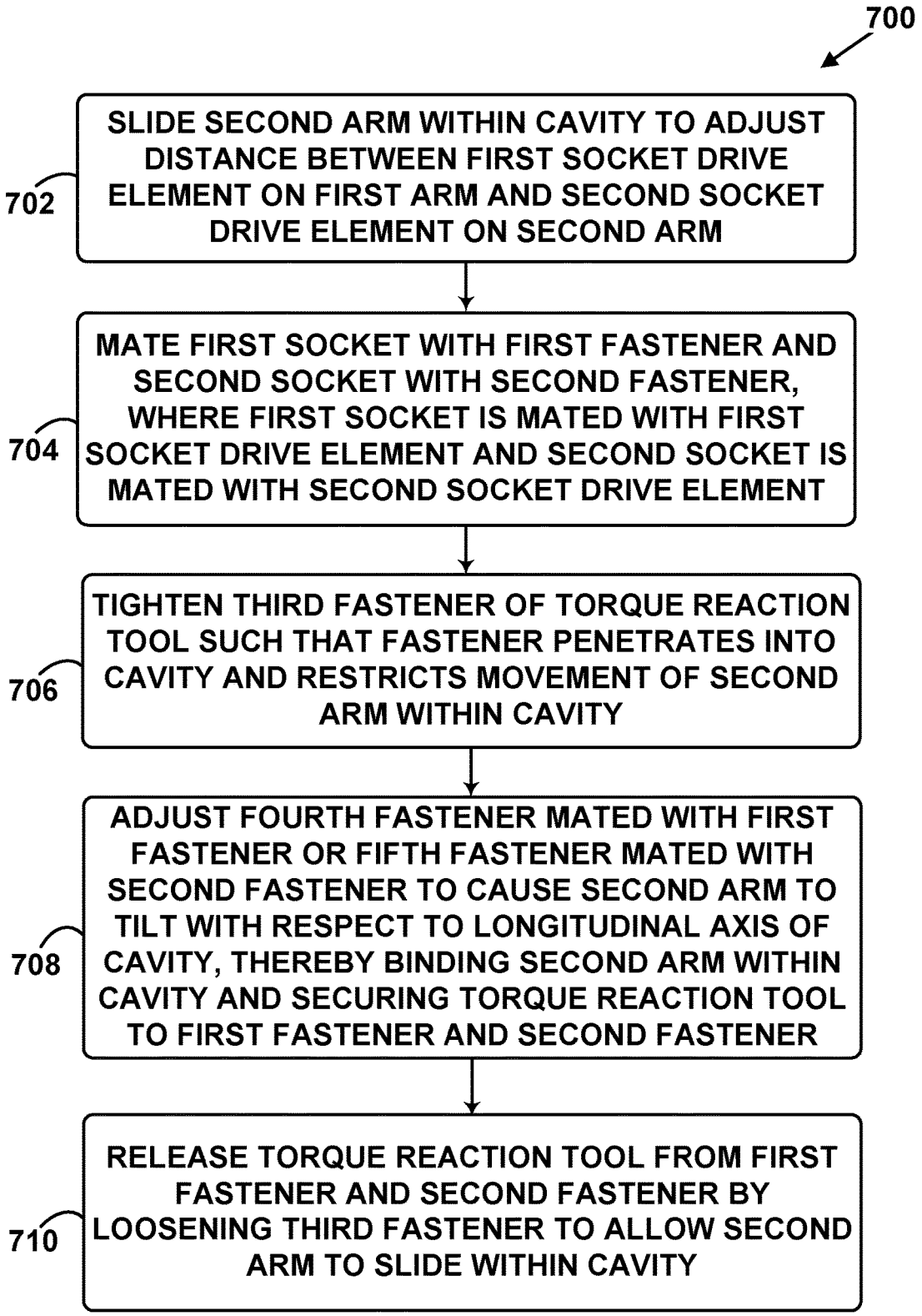
FIG. 7 is a block diagram of a method, according to an example embodiment.

FIG. 7 is a block diagram of a method 700 for using a torque reaction tool having a first arm and a second arm slidably disposed within a cavity of the first arm. For example, the method 700 could be used in conjunction with the torque reaction tools 100 or 200.

At block 702, the method 700 includes sliding the second arm within the cavity to adjust a distance between a first socket drive element on the first arm and a second socket drive element on the second arm. When using the torque reaction tool 100, a technician may slide the arm 114 within the cavity 106 to adjust the distance 154 between the socket drive element 110 and the socket drive element 120. The distance 154 may be adjusted to match a distance between the fasteners 134 and 136. When using the torque reaction tool 200, the technician may slide the arm 214 within the cavity 206 to adjust the distance 254 between the socket drive element 210 and the socket drive element 220. The distance 254 may be adjusted to match a distance between the fasteners 234 and 236.

At block 704, the method 700 includes mating a first socket with a first fastener and a second socket with a second fastener. In this context, the first socket is mated with the first socket drive element and the second socket is mated with the second socket drive element. When using the torque reaction tool 100, the technician may mate the socket 130 with the fastener 134 and mate the socket 132 with the fastener 136. The technician may also mate the socket 130 with the socket drive element 110 and mate the socket 132 with the socket drive element 120. When using the torque reaction tool 200, the technician may mate the socket 230 with the fastener 234 and mate the socket 232 with the fastener 236. The technician may also mate the socket 230 with the socket drive element 210 and mate the socket 232 with the socket drive element 220.

At block 706, the method 700 includes tightening a third fastener of the torque reaction tool such that the third fastener penetrates into the cavity and restricts movement of the second arm within the cavity. When using the torque reaction tool 100, the technician may tighten the fastener 122 into the threaded hole 124 or the threaded hole 125 such that the fastener 122 penetrates into the cavity 106 and restricts movement of the arm 114 within the cavity 106. When using the torque reaction tool 200, the technician may tighten the fastener 222 into the threaded hole 224 such that the fastener 222 penetrates into the cavity 206 and restricts movement of the arm 214 within the cavity 206.

When using the torque reaction tool 100, the technician may also insert the threaded end 140 of the handle 138 into the threaded hole 142 to further restrict the end portion 116 from moving within the cavity 106. When using the torque reaction tool 200, the technician may insert the threaded end 240 of the handle 238 into the threaded hole 242 or 249 to further restrict the end portion 216 from moving within the cavity 206.

At block 708, the method 700 includes adjusting a fourth fastener mated with the first fastener or a fifth fastener mated with the second fastener to cause the second arm to tilt with respect to a longitudinal axis of the cavity, thereby binding the second arm within the cavity and securing the torque reaction tool to the first fastener and the second fastener.

When using the torque reaction tool 100, the technician may turn the fastener 135 that is mated with the fastener 134 to cause the arm 114 to tilt with respect to the longitudinal axis 112, which may cause the arm 114 to bind within the cavity 106 and secure the torque reaction tool 100 to the fastener 134 and the fastener 136. More specifically, the torque applied to the fastener 135 may cause the fastener 134 to transfer a torque to the socket drive element 110 via the socket 130. The transferred torque may cause the arm 102 to rotate and bind against the arm 114 in the cavity 106. Similarly, torque applied to the fastener 137 may cause the fastener 136 to transfer a torque to the socket drive element 120 via the socket 132. The transferred torque may cause the arm 114 to rotate and bind against the arm 102 in the cavity 106.

When using the torque reaction tool 200, the technician may turn the fastener 235 that is mated with the fastener 234 to cause the arm 214 to tilt with respect to the longitudinal axis 212, which may cause the arm 214 to bind within the cavity 206 and secure the torque reaction tool 200 to the fastener 234 and the fastener 236. More specifically, the torque applied to the fastener 235 may cause the fastener 234 to transfer a torque to the socket drive element 210 via the socket 230. The transferred torque may cause the arm 202 to rotate and bind against the arm 214 in the cavity 206. Similarly, torque applied to the fastener 237 may cause the fastener 236 to transfer a torque to the socket drive element 220 via the socket 232. The transferred torque may cause the arm 214 to rotate and bind against the arm 202 in the cavity 206.

Once the torque reaction tool 100 or 200 is in the bound state and secured to the fasteners 134/234 and 136/236, the technician may tighten or loosen the fasteners 135/235 and 137/237 while the torque reaction tool 100 or 200 applies a holdback torque that facilitates loosening or tightening of the fasteners 135/235 and/or 137/237.

At block 710, the method 700 includes releasing the torque reaction tool from the first fastener and the second fastener by loosening the third fastener to allow the second arm to slide within the cavity. When using the torque reaction tool 100, the technician may loosen the fastener 122 in the threaded hole 124 and/or loosen the handle 138 in the threaded hole 142 to allow the end portion 116 to move within the cavity 106 and to release the torque reaction tool 100 from the fasteners 134 and 136. When using the torque reaction tool 200, the technician may loosen the fastener 222 in the threaded holes 124 or 125 and/or loosen the handle 238 in the threaded holes 242 or 249 to allow the end portion 216 to move within the cavity 206 and to release the torque reaction tool 200 from the fasteners 234 and 236.

The description of the different advantageous arrangements has been presented for purposes of illustration and description, and is not intended to be exhaustive or limited to the embodiments in the form disclosed. Many modifications and variations will be apparent to those of ordinary skill in the art. Further, different advantageous embodiments may describe different advantages as compared to other advantageous embodiments. The embodiment or embodiments selected are chosen and described in order to explain the principles of the embodiments, the practical application, and to enable others of ordinary skill in the art to understand the disclosure for various embodiments with various modifications as are suited to the particular use contemplated.

What is claimed is:

1. A torque reaction tool comprising:

a first arm having an end with a longitudinally extending cavity, and an opposite end with a first socket drive element disposed perpendicular to a longitudinal axis of the cavity;

a second arm having an end portion slidably disposed within the cavity, and an opposite end with a second socket drive element thereon, oriented in the same direction as the first socket drive element; and a first fastener, disposed in a first threaded hole in the first arm that extends into the cavity, the first fastener being adjustable to engage the end portion of the second arm to restrict sliding movement of the second arm relative to the first arm;

wherein the end portion of the second arm has a width that is not more than 90 percent of a width of the cavity, such that the end portion of the second arm is configured to rotationally bind within the cavity in response to torque applied about the first socket drive element or the second socket drive element, when coupled respectively to a first socket and a second socket positioned respectively over a second fastener and a third fastener.

2. The torque reaction tool of claim 1, further comprising a handle, having a threaded end disposed in a second threaded hole in the first arm that extends into the cavity, the threaded end having a length sufficient to extend into the cavity and engage the end portion of the second arm to restrict movement of the second arm.

3. The torque reaction tool of claim 2, with one or more of the following:

wherein the end portion of the second arm has a cross-sectional width and a cross-sectional height that are respectively not more than 90 percent of the cross-sectional width and a cross-sectional height of the cavity, wherein the end portion of the second arm is slidable within the cavity such that a distance between the first socket drive element and the second socket drive element is adjustable, wherein the end portion of the second arm has a non-cylindrical cross-sectional shape that inhibits rotation of the second arm relative to the first arm about the longitudinal axis of the cavity.

4. The torque reaction tool of claim 2, wherein a cross-section of the cavity has an oval shape.

5. The torque reaction tool of claim 2, wherein a cross-section of the cavity has a rectangular shape.

6. The torque reaction tool of claim 2, with one or more of the following:

wherein one or more of the first socket drive element or the second socket drive element comprise a protrusion configured to receive a socket that is configured to apply a rotational force to a fastener, wherein the first socket drive element is on a first surface of the first arm, and wherein the first threaded hole is on a second surface of the first arm that is perpendicular to the first surface.

7. The torque reaction tool of claim 2, wherein the second arm is movable within the cavity to change a distance between the first socket drive element and the second socket drive element, wherein the second arm comprises a groove configured to receive the first fastener, wherein the groove comprises an end, and wherein the first fastener is configured to restrict movement of the second arm out of the cavity by contacting the end of the groove.

8. The torque reaction tool of claim 2, further characterized in that:

the first arm comprises a first orthogonally extending arm having an end with a longitudinally extending cavity, and an opposite end with a first socket drive element disposed perpendicular to a longitudinal axis of the cavity; and the second arm comprises a second orthogonally extending arm having an end portion slidably disposed within the cavity, and an opposite end with a second socket drive element thereon, oriented in the same direction as the first socket drive element.

9. The torque reaction tool of claim 2, wherein loosening the threaded end of the handle disposed in the second threaded hole and loosening the first fastener disposed in the first threaded hole allows the end portion to move within the cavity and to release the torque reaction tool from the second fastener and the third fastener.

* * * * *